United States Patent [19]

Fortenberry

[11] 3,981,359

[45] Sept. 21, 1976

[54] CENTRALIZER ELEMENT FOR WELL SCREEN

[75] Inventor: Dewitt L. Fortenberry, Lafayette, La.

[73] Assignee: UOP Inc., Des Plaines, Ill.

[22] Filed: Oct. 21, 1975

[21] Appl. No.: 624,511

[52] U.S. Cl. ..... 166/241

[51] Int. Cl.[2] ..... E21B 17/10; E21B 43/10

[58] Field of Search ..... 166/241, 166, 173, 205, 166/235

[56] References Cited

UNITED STATES PATENTS

| | | | |
|---|---|---|---|
| 2,253,675 | 8/1941 | Arnold | 166/241 |
| 2,651,369 | 9/1953 | Abendroth et al. | 166/205 X |
| 3,292,708 | 12/1966 | Mundt | 166/241 |
| 3,343,890 | 9/1967 | Homer | 166/241 X |
| 3,420,309 | 1/1969 | Beylik | 166/235 X |

*Primary Examiner*—Stephen J. Novosad
*Attorney, Agent, or Firm*—James R. Hoatson, Jr.; Barry L. Clark; William H. Page, II

[57] ABSTRACT

Centralizer assembly for an oil well screen has two identical halves which are fastened together around a well screen to permit the well screen to be properly centered within a tubular well casing. A shoulder or lip at one end of the centralizer engages a recess adjacent the end of the well screen to limit axial movement of the centralizer relative to the well screen.

2 Claims, 4 Drawing Figures

CENTRALIZER ELEMENT FOR WELL SCREEN

BACKGROUND OF THE INVENTION

In most oil well completions, a centralizer is used to center the screen within the casing. When gravel is introduced between the casing and screen, the centralizer ensures that the gravel is of even radial thickness in the annular space. It is important in the installation of the screen that the centralizer be axially fixed in place. A centralizer which is not fixed in place will tend to slide along the screen and string of pipe if its projecting ears become hung up within the casing, such as on a casing joint. Such movement of the centralizer with respect to the screen will negate the centralizer's function. The common clamp-on centralizer is susceptible to this failure. The welded-in-place centralizer avoids the problem, but has other disadvantages. The clamp-on centralizer offers ease of installation, flexibility of axial location, and requires no specialized equipment such as welders.

SUMMARY

It is among the objects of the present invention to provide a centralizer which has the advantages of the prior art clamp-on and welded types while eliminating the disadvantages.

My improved centralizer includes an internal lip, or shoulder, at one end. This lip is an integral part of each half of the sand-cast aluminum clamp-type centralizer. When installed, the centralizer is clamped about the end of the screen so that the inner lip is around the end fitting of the screen. The end fitting is of a smaller diameter than the screen itself, and fits into a coupling whose diameter is also larger than the end fitting. Thus, the lip is captured axially between the screen and the coupling, preventing axial movement of the centralizer, and providing the user with the advantages of the clamp-on centralizer plus the fixed axial location of the welded centralizer.

If it is desired that a centralizer be installed midway along the screen body, as in the case of a very long screen section, the lip portion of the centralizer may be cut off. This will allow the centralizer to be used as a conventional centralizer, losing, of course, the positive axial location feature.

DESCRIPTION OF THE PREFERRED EMBODIMENT

Figure 1:
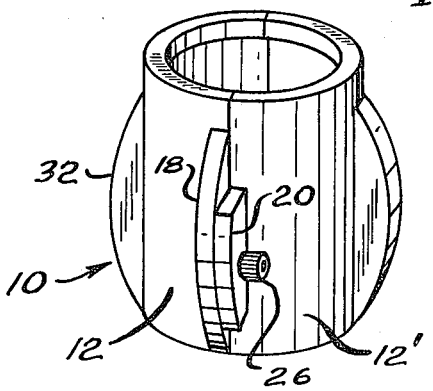
FIG. 1 is a perspective view of my improved centralizer.
Figure 2:
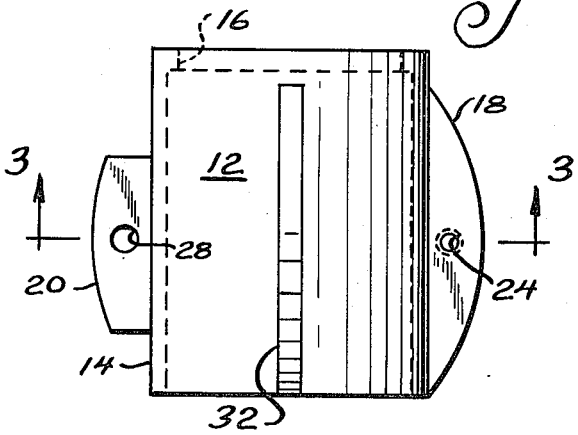
FIG. 2 is a side view of one of the two identical castings used to form the centralizer.
Figure 3:
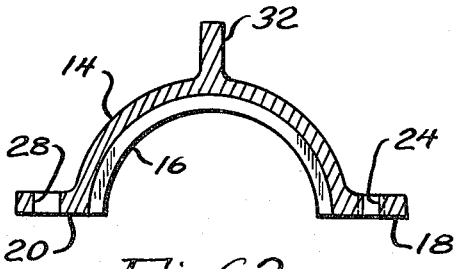
FIG. 3 is a bottom view of the centralizer shown in FIG. 2.

Referring to FIGS. 1–3, the improved centralizer indicated generally at 10 comprises a pair of identical housing portions 12,12' which each include a semi-cylindrical annular wall portion 14 and an inwardly extending lip portion 16. A pair of clamping flanges

18,20 extend radially outwardly in a common plane from the side edges of the wall portion 14. An aperture 24 formed in flange 18 is threaded for receipt of the threads on fastener 26 while aperture 28 in flange 20 is of a larger diameter than the threads on fastener 26. Thus, clamping force is applied between the heads of fasteners 26 and the threaded apertures 24 to force the housing portions 12,12' toward each other.

A central flange portion 32 extends radially outwardly from the wall portion 14 midway between flanges 18,20 and for about the same distance. The flanges 18,20 and 32 each have a rounded peripheral surface as shown in FIGS. 1 and 2 to help guide the centralizer 10 over any joints 36 between lengths of well casing 38,38' (FIG. 4).

Figure 4:
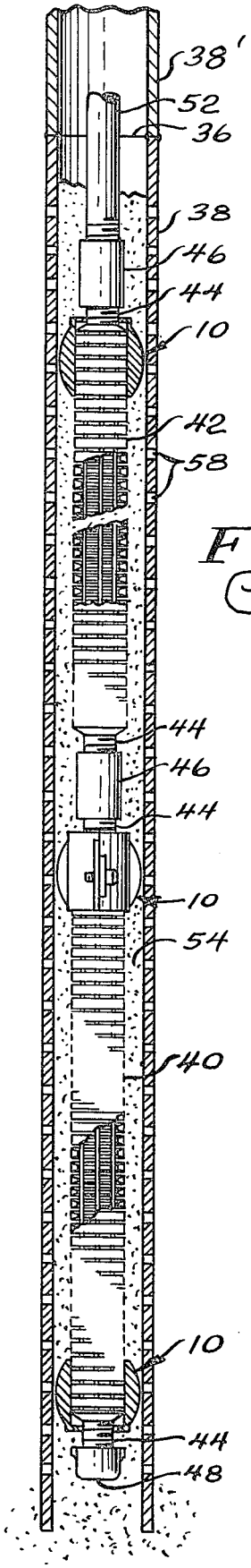
FIG. 4 is a side sectional view illustrating the relationship between a well casing, a well screen and my improved centralizers.

FIG. 4 illustrates the manner in which a plurality of centralizers 10 are utilized to centralize well screens 40,42 inside casing 38. Threaded pipe members 44 extend from the ends of the screen 40,42 and are joined by couplings 46 or an end cap 48. The exposed portions of the pipe members 44 define regions of reduced diameter relative to the well screen and coupling diameters and cooperate with the lip portions 16 on the centralizers 10 to limit the amount of relative movement possible between the centralizers and screens. Once the well screens 40,42 are lowered by drop pipe 52 to their desired final position, the area around them is packed with gravel 54. The oil which is in the ground surrounding the casing 38 passes through casing perforations 58, gravel 54 and the openings in the well screens 40,42 before it is drawn upwardly through pipe 52.

I claim as my invention:

1. A centralizer for axially centering a well screen within a tubular well casing, said centralizer comprising a pair of identical housing portions having a generally semi-cylindrical, annular wall cross-section along substantially the entire axial length thereof, one end of said wall having an integral, inwardly extending lip portion formed thereon, a pair of integral, outwardly extending flange portions formed in a common plane and extending from each side edge of said housing portions, each one of said pair of flange portions having an aperture therein so that when a pair of housing portions are positioned opposite each other and in surrounding relation to a well screen, fastener members can pass through said apertures to clamp said housing portions together, and an outwardly extending flange portion on each housing portion arranged between said pair of flange portions, each of said flange portions extending about the same distance from the inner wall of said housing portions so as to center a well screen to which said housing portions are adapted to be clamped within a well casing which is just slightly larger in internal diameter than the distance between the tips of any pair of flange portions lying in a common plane, said lip portions being adapted to fit into a recessed area of limited axial extent adjacent the end of a well screen to prevent axial shifting of said centralizer relative to a well screen to which it is clamped.

2. A centralizer in accordance with claim 1 wherein each of said flange portions has a cross section in the axial plane of the centralizer which progressively increases in radial dimension as one proceeds in a direction from the ends of the centralizer toward its center.

* * * * *